United States Patent [19]

Dale

[11] 4,132,053

[45] Jan. 2, 1979

[54] APPARATUS FOR SECURING ARTICLES TO A DISPLAY BOARD

[76] Inventor: Stanford W. Dale, 5228 Brookdale Ct., Minnetonka, Minn. 55443

[21] Appl. No.: 842,279

[22] Filed: Oct. 14, 1977

[51] Int. Cl.[2] ..... B65B 61/00

[52] U.S. Cl. ..... 53/137; 53/580; 156/559; 156/566

[58] Field of Search ..... 53/137, 139.3, 191, 53/196; 156/559, 566

[56] References Cited

U.S. PATENT DOCUMENTS

| | | | |
|---|---|---|---|
| 3,286,835 | 11/1966 | Crane, Jr. | 53/196 X |
| 3,541,756 | 11/1970 | Mateski | 53/137 |
| 3,698,551 | 10/1972 | Tomlinson | 53/14 X |
| 3,885,373 | 5/1975 | Place | 53/137 X |

FOREIGN PATENT DOCUMENTS

| | | | |
|---|---|---|---|
| 844857 | 8/1960 | United Kingdom | 53/196 |

*Primary Examiner*—John Sipos

*Attorney, Agent, or Firm*—Hamilton, Renner & Kenner

[57] ABSTRACT

Disclosed is an apparatus for the display packaging of articles upon a card. The apparatus includes a conveyor assembly for moving display cards through the apparatus so that various operations for forming the display package can be performed, a card feeding assembly which supplies single display cards to the conveyor assembly, article feeding means for supplying the article to be packaged to the conveyor assembly, labelling means and affixing means for securing a label to the article and the display card. The apparatus may additionally include a second labelling means and affixing means for application of a second label to the display package.

15 Claims, 16 Drawing Figures

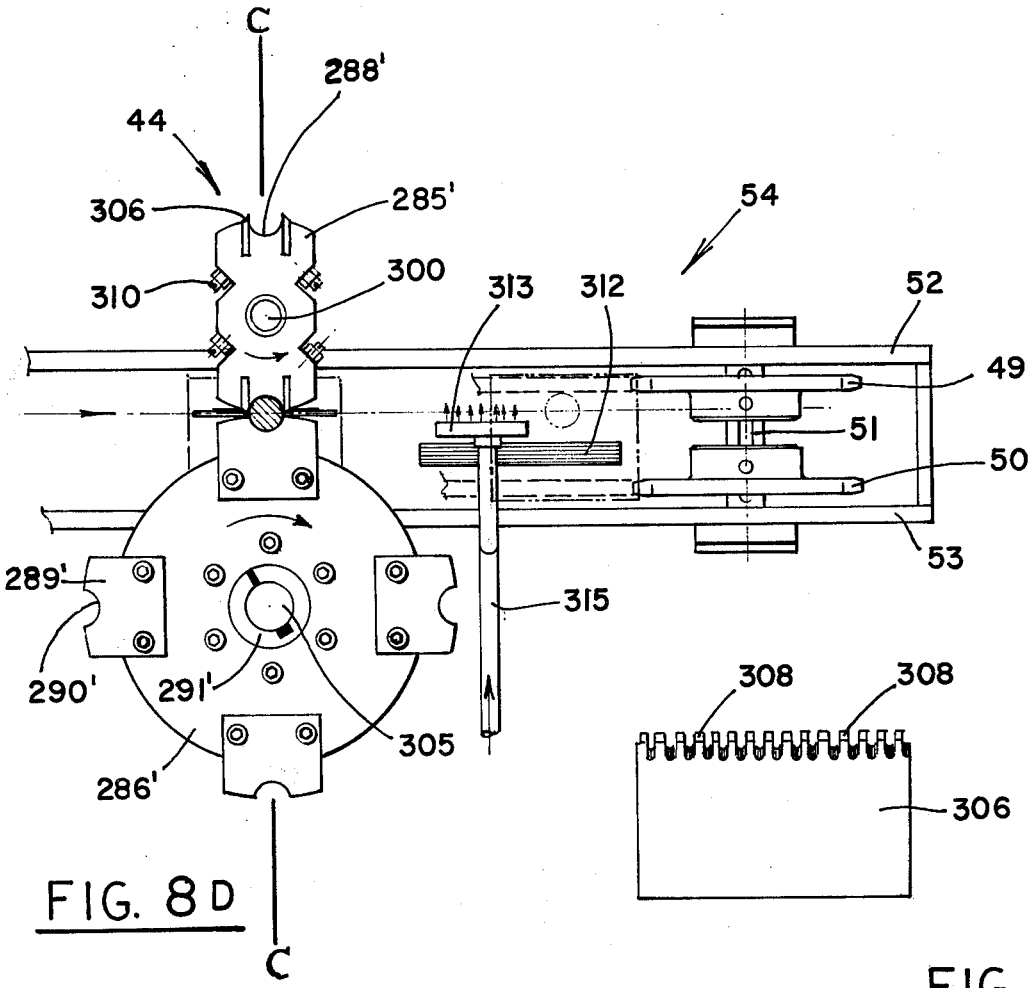
FIG. 8D
FIG. 10
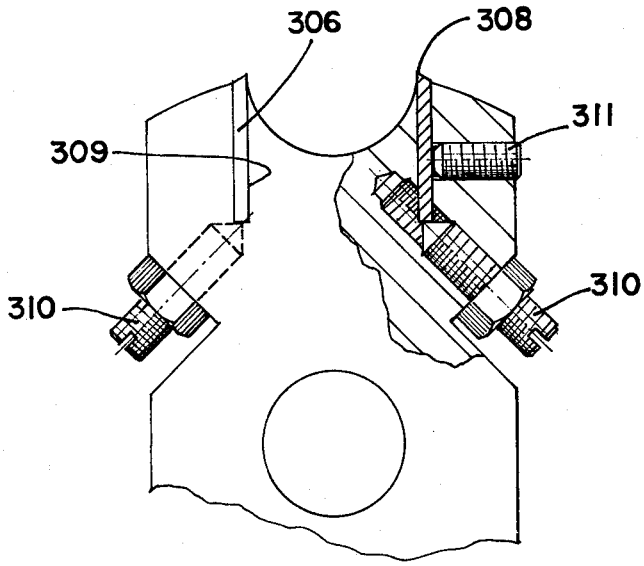
FIG. 9

APPARATUS FOR SECURING ARTICLES TO A DISPLAY BOARD

BACKGROUND OF THE INVENTION

Concepts of packaging small goods including household products and personal items have been steadily changing from the day when most of the goods were sold in closed containers particularly cardboard boxes and paper wrappers. Packages are necessary for several reasons some of the more common ones being, to protect the product during shipment and subsequent display prior to the time of purchase by the consumer, to advertise the goods and to prevent tampering with the product by unauthorized persons.

Many products are also sold without the aid of packages because they are of such a nature that the consumer generally wishes to inspect them, or simply because they do not require protection or any appreciable amount of advertising. While lack of packaging represents a savings to the manufacturer, the retailer is often plagued with the theft of such goods, which include lipstick containers, ballpoint pens, spools of thread, combs, small toys and the like. One of the remedies to the theft of small items that has evolved has been effected by mounting the small product on a larger display card of a fairly rigid cardboard which increases the difficulty of inconspicuous theft.

The display card method of packaging also places the product in full view of the consumer and again provides the manufacturer the space for advertising. Most of the packages include a display panel of cardboard or similar material upon which may be printed product information, advertisement and directions. The article is placed upon the card and then affixed thereto by selecting a suitable method such as completely enveloping the article and display panel with a layer of clear plastic which may be either rigid or a flexible film.

In the interest of minimizing packaging material and labor, one method utilizes the label, normally affixed to the article, as the means for fastening the article to the display panel. The label, which is preferably self-adhesive, may be imprinted with directions or other desired information and is affixed directly to the article and display panel as though the article were being taped to a card. Following purchase, the consumer simply removes the article from the display panel and discards the latter.

Apparatus and a method for such packaging have been set forth in U.S. Pat. No. 3,885,373, owned by my common Assignee, Cardpak, Inc. While the foregoing apparatus is satisfactory for packaging of lightweight articles, it has now been found that heavier products are more firmly held when the display board presents a foot or ledge for support of the product. Such support permits greater handling of the package without the risk of the product inadvertently breaking loose from the display card. Apparatus for producing such packages at a high rate has not, heretofore, been known to me.

SUMMARY OF THE INVENTION

It is therefore an object of the present invention to provide an apparatus for packaging an article by mounting it on a display card in full view, with adequate space for advertisements, directions and other information.

It is another object of the present invention to provide an apparatus for packaging an article which is supported by a display card and affixed thereto by the use of one or more labels.

It is yet another object of the present invention to provide an apparatus for packaging an article with a display card larger than the article, thereby reducing the ease with which the article may be pilfered.

It is a further object of the present invention to provide an apparatus for packaging an article on a display card with one or more labels in such a manner that the labels remain permanently affixed to the article when the latter is intentionally separated from the card.

It is a still further object of the present invention to provide an apparatus for packaging an article utilizing a minimum amount of materials and a minimum number of operations so as to be totally automated with a corresponding savings in time and labor.

These and other objects, together with the advantages thereof over existing and prior art forms, which will become apparent from the following specification are accomplished by means hereinafter described and claimed.

In general, an apparatus embodying the concept of the present invention for packaging articles includes a conveyor assembly for moving display cards through the apparatus so that various operations for forming the display package can be performed, a card feeding assembly which supplies single display cards to the conveyor assembly, article feeding means for supplying the article to be packaged to the conveyor assembly, labelling means and affixing means for securing a label to the article and the display card.

In operation, a display card is fed from a supply onto the conveyor assembly which orients and shapes the card for receipt of the article. The article to be packaged is subsequently fed onto the conveyor assembly in communication with the card. Next, a label is fed from a supply to the article which is in turn applied to the article and the card by the action of the label affixing means. The apparatus may additionally include a second labelling means and affixing means for application of a second label to the display package.

BRIEF DESCRIPTION OF THE DRAWINGS

FIGS. 8A–8D are contained on four separate sheets and depict schematically, in top plan, various portions of the apparatus embodied by the present invention; FIG. 8A including that portion of the apparatus from the card feeding mechanism to the line a—a and including the mechanism for feeding articles; FIG. 8B including that portion of the apparatus from the line a—a to the line b—b and depicting one label feeding mechanism; and, FIG. 8C including that portion of the apparatus from the line b—b to the line c—c and depicting a first label affixing assembly and a second label feeding mechanism; and FIG. 8D including that portion of the apparatus from the second label affixing assembly to the end;

FIG. 9 is an enlarged top plan of a portion of the label affixing assembly;

FIG. 10 is a side elevation of a knife utilized by a label affixing assembly;

DESCRIPTION OF THE PREFERRED EMBODIMENT

Figure 12:
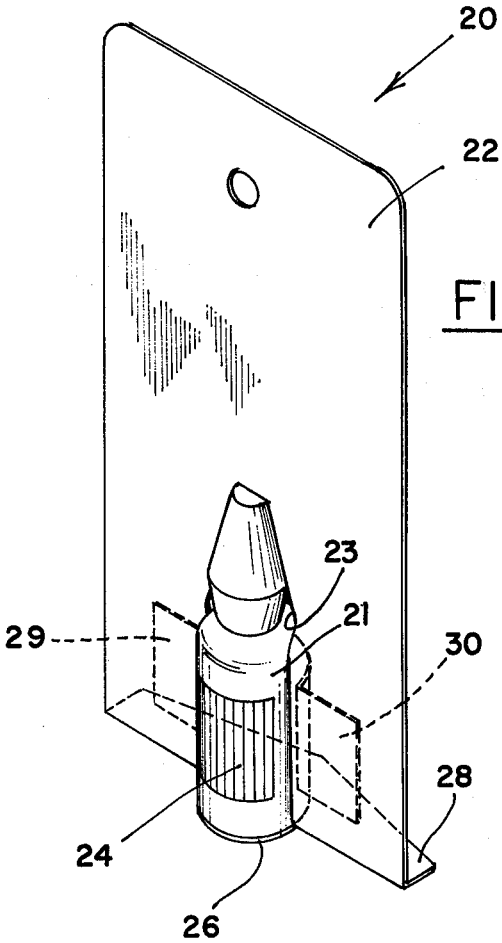
FIG. 12 is a perspective view of a package produced by the apparatus of the present invention depicting an article, a display card and a label; and, FIG. 13 is an exploded perspective view of an article and two labels one of which is utilized to affix the article to the display card of FIG. 11.
Figure 13:
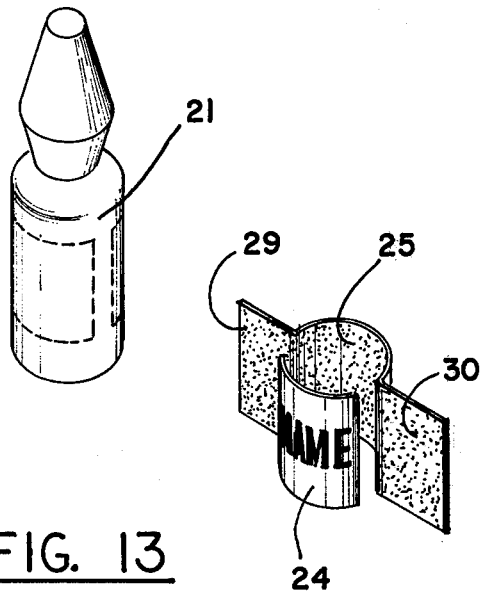

Referring more particularly to the drawings, a display package, indicated generally by the numeral 20, is depicted in FIGS. 12 and 13 and is representative of the type of package which may be assembled upon the subject apparatus. The display package 20 includes an article 21 of any conventional size and shape, a display card 22 of stiff paper, plastic, thin metal or other suitable material, generally larger than the article and having a cut out portion or opening 23 which approximately corresponds to the outline of the article 21, and labels 24 and 25 at least one of which is utilized to join the article 21 and display card 22 together.

In order to provide further support for the article 21, particularly if the package 20 is to be hung for display or alternatively is to stand upright, a foot 26 is provided as part of a base 28 extending perpendicularly from the display card. It will be noted that the label 24 depicted in FIGS. 12 and 13 attaches only to the article 21. The label 25 does, however, adhere to the article 21, and extended ends 29 and 30 adhere to the card 22, serving to connect the two together to form the package 20. While either the front or the back label need be employed to fasten the article 21 to the card 20, some embodiments may require both labels to adhere to the card in the interest of strengthening the package as well as increasing the effort required to separate the article from the card. However, for most normal applications, one label may serve as the means for fastening the article to the card and when so employed, removal of the article is greatly facilitated.

Figure 1:
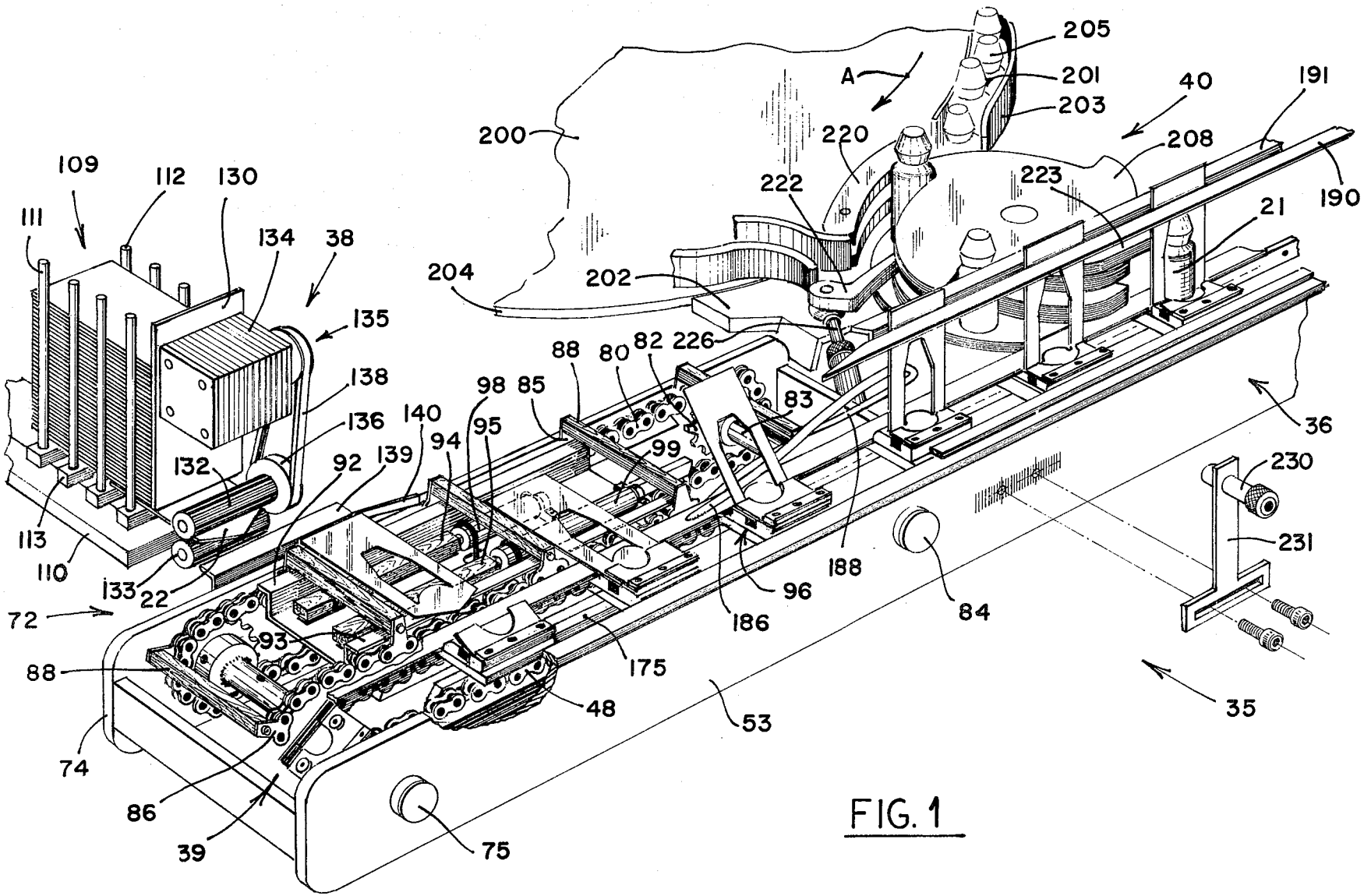
FIG. 1 is a perspective view of a portion of the apparatus embodied by the present invention depicting entry of a card and the advancement thereof to an article feeding stage.
Figure 2:
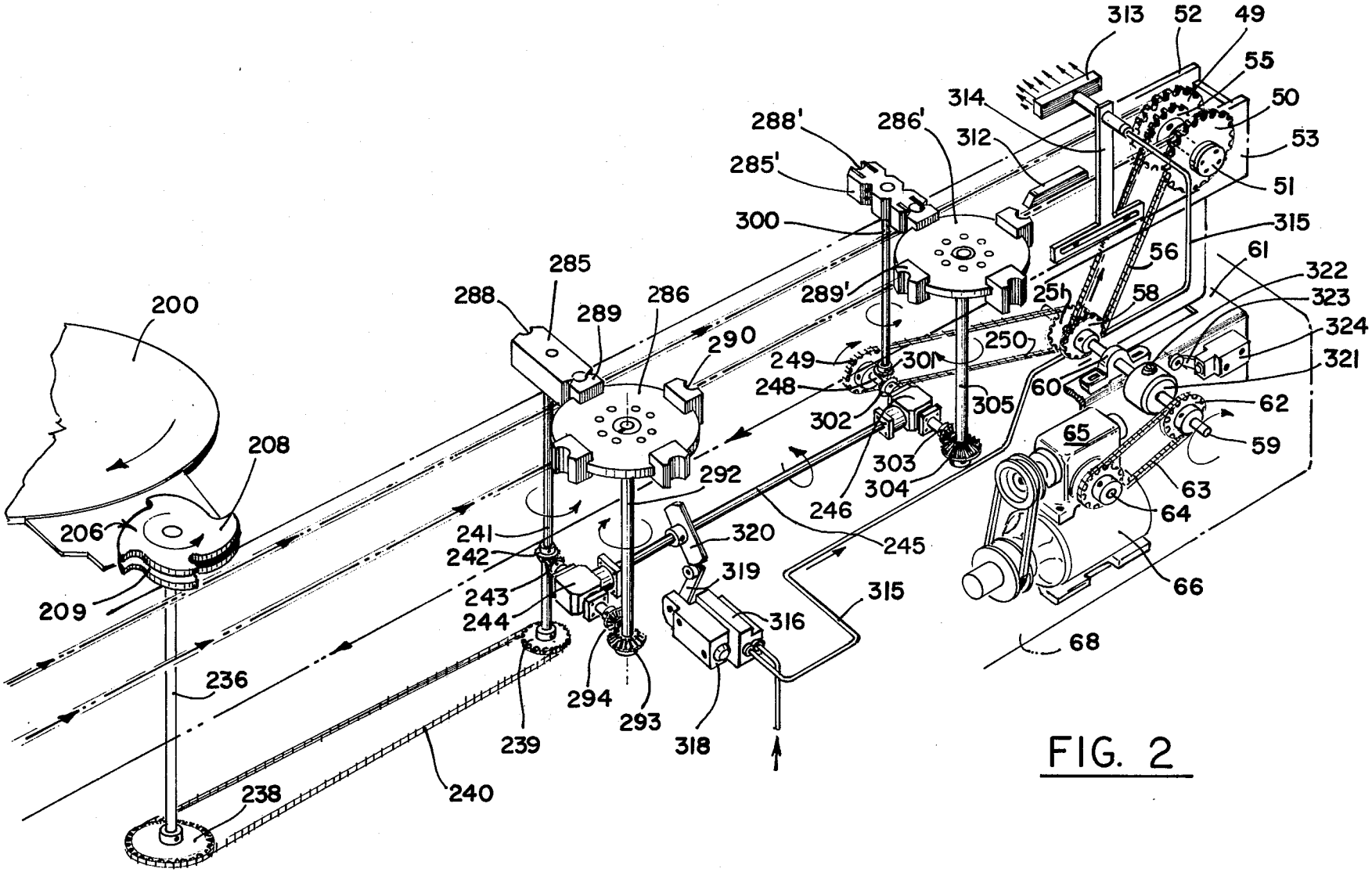
FIG. 2 is a schematic perspective of the drive train of the apparatus.
Figure 8A:
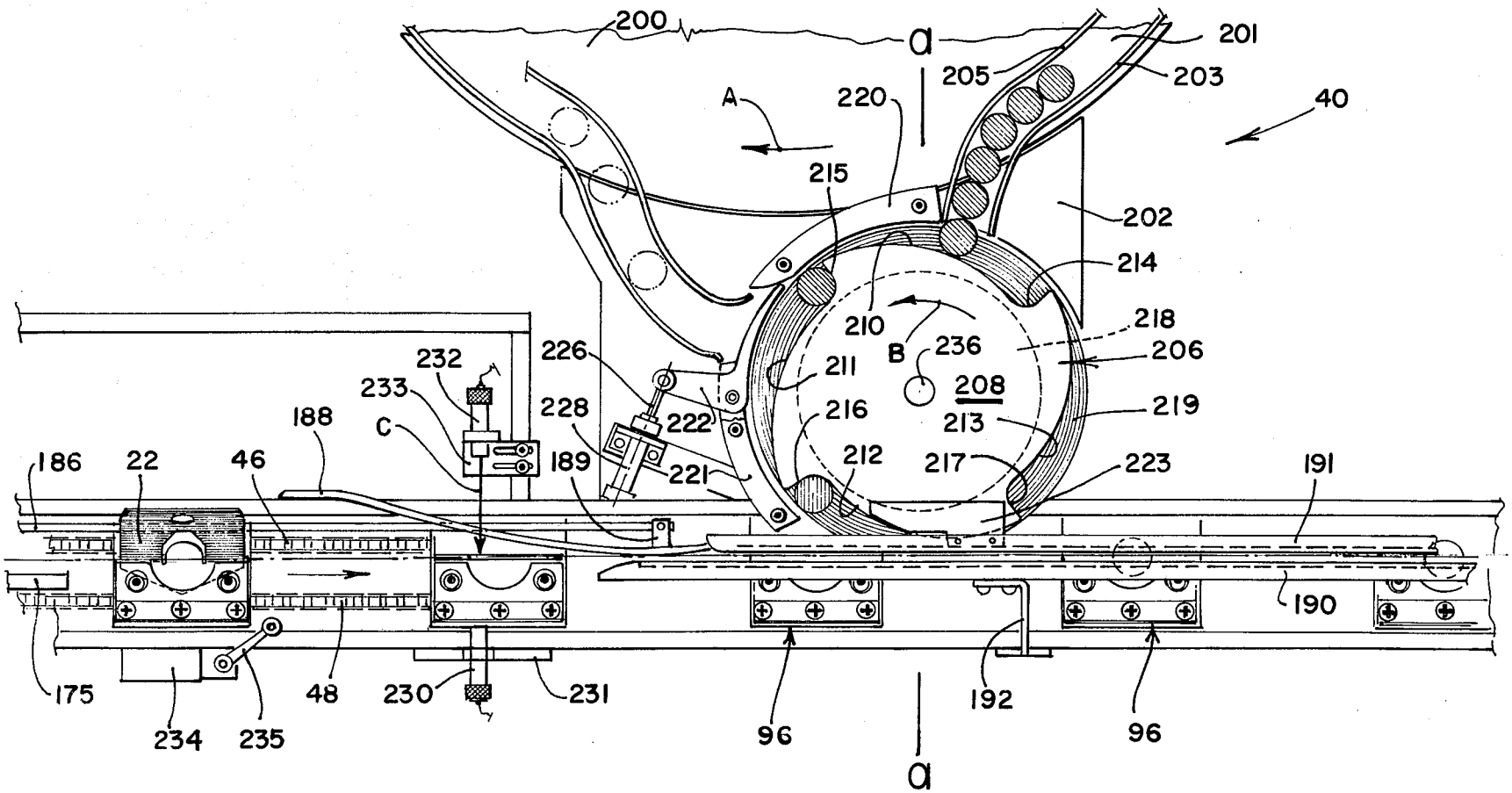
Figure 8B:
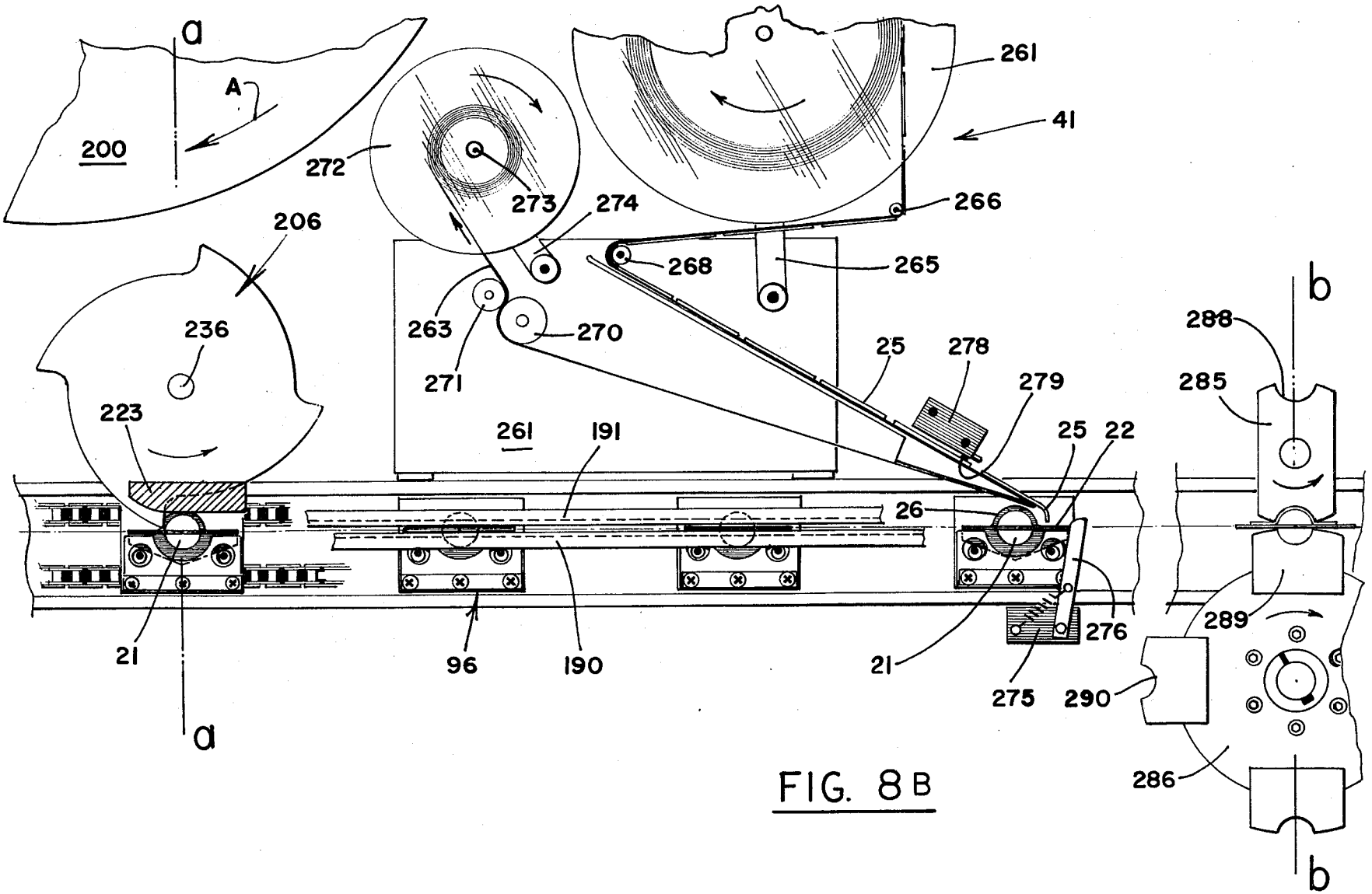
Figure 8C:
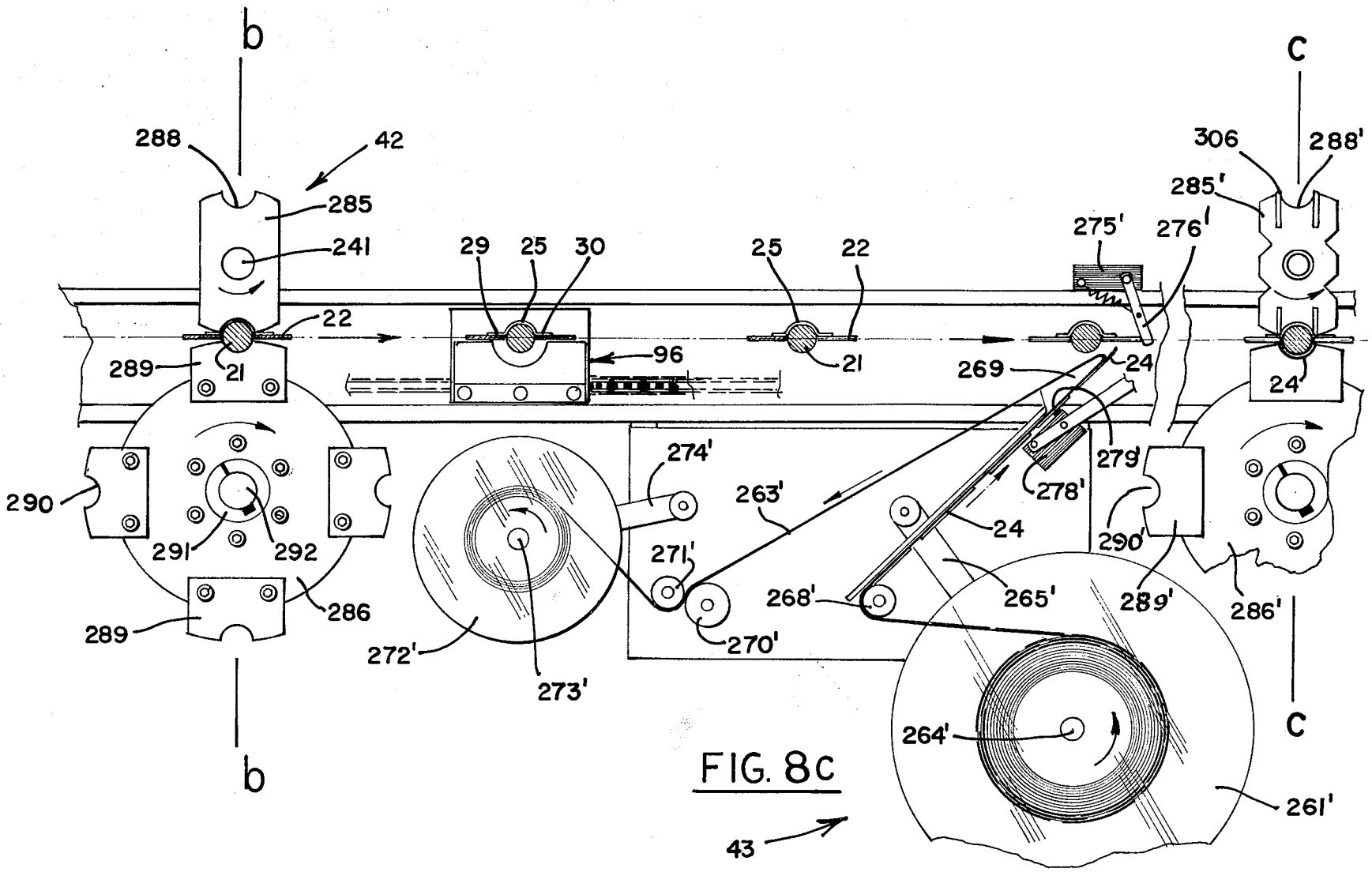

The apparatus of the present invention, indicated generally by the numeral 35, includes the following elements: an upper frame 36, a card feeding assembly 38, a conveyor assembly for moving display cards 39 through the apparatus and means for feeding articles 40 into the apparatus, each depicted in FIG. 1; a first label applicating means 41, depicted in FIG. 8B; a first label affixing assembly 42 and second label applicating means 43 depicted in FIG. 8C; and, a second label affixing assembly 44 depicted in FIG. 8D. A drive system 45 is also included and is depicted in FIG. 2.

With reference to FIGS. 1–7 and 10, the conveyor assembly for moving display cards 39 through the apparatus 35 includes a pair of chains 46 and 48 which traverse the entire length of the upper frame 36. The chains 46 and 48 are driven by sprockets 49 and 50, respectively, carried by a shaft 51 rotatably mounted between sideplates 52 and 53 of frame 36 at the tail end 54 of the apparatus where the finished package 20 is removed. A third sprocket 55 is affixed to the shaft 51 and is in turn driven by a sprocket 56 and sprocket 58. Sprocket 58 is affixed to powershaft 59 supported in pillow block 60 upon a lower frame member 61 and is itself driven by sprocket 62 and chain 63 which derives its power from the output sprocket 64 of a gear reduction unit 65 and motor 66 resting upon a bedframe member 68.

The chains 46 and 48 pass around sprockets 70 and 71, respectively, at the head end 72 of apparatus 35 where the display cards 22 are fed. The sprockets 70 and 71 are affixed to and drive a shaft 73 which passes through frame sideplates 52 and 53 and an additional rear sideplate 74 and is rotatably mounted in bearings 75 and 76. The shaft 73 carries two sprockets 78 and 79, between sideplates 52 and 74, which drive chains 80 and 81, respectively, around a pair of sprockets, 82 in FIG. 1, affixed to a shaft 83, also rotatably mounted in bearings 84.

The chains 80 and 82 are provided at regular intervals with accessory attachment links 85 and 86, respectively, between each pair of which is mounted a card positioning bar 88 of wood or other suitable material. Chain slide rails 89 and 90 underlie chains 80 and 81, respectively, to prevent the chains from sagging between sprockets. As a display card 22 is fed from the rear of card feeding assembly 38, it enters a fixed platform or trough 91 supported between chains 80 and 81 by means not shown. Flanges 92 and 93 extend over the chains 80 and 81 to protect an incoming card 22 from fouling therewith. The trough 91 carries two elongated blocks 94 and 95 which elevate the card 22 sufficiently for receipt by a movable cardgripper indicated by the numeral 96. The blocks 94 and 95 are generally perpendicularly disposed with respect to the overhead transverse bars 88 and are generally axially aligned with the chains 80 and 81. The upper surface of the blocks 94 and 95 essentially forms a table for support of the cards 22 and the positioning thereof prior to being moved into the cardgripper 96.

Immediately upstream of the blocks 94 and 95 and axially aligned therewith are two rotatable rubber rollers 98 and 99 journaled in suitable bearings supported by the trough 91. Each roller 98, 99 is driven by a rubber belt, 100 and 101, respectively, from motor 102 in a clockwise direction when viewed from the head end of apparatus 35. The motor 102 is preferably mounted beneath the trough via means not shown and the belts 100 and 101 pass through slots in the trough 91 provided therefor. This structure is depicted in FIG. 1 and in FIG. 4, wherein block 95 has been removed for clarity.

In operation, a card is deposited onto the blocks 94 and 95 where it momentarily resides. Passage of an overhead positioning bar 88 slides the card along the blocks 94 and 95 parallel to the longitudinal axis of the apparatus 35. After the card is drawn over the blocks 94 and 95, it descends onto the rollers 98 and 99 which drive the card perpendicularly from the longitudinal axis of the apparatus 35 into an axially moving cardgripper 96. Because both card 22 and cardgripper 96 are moving axially during feeding, the second roller 99 which is closer to the cardgripper 96 is longer than the rearward roller 98.

In order to maintain the card 22 firmly against the blocks 94 and 95 and rollers 98 and 99, an adjustable brush 103 (FIGS. 3 and 4) is provided thereabove, carried by an arm 104 supported by a bracket 105 affixed to sideplate 53.

Figure 3:
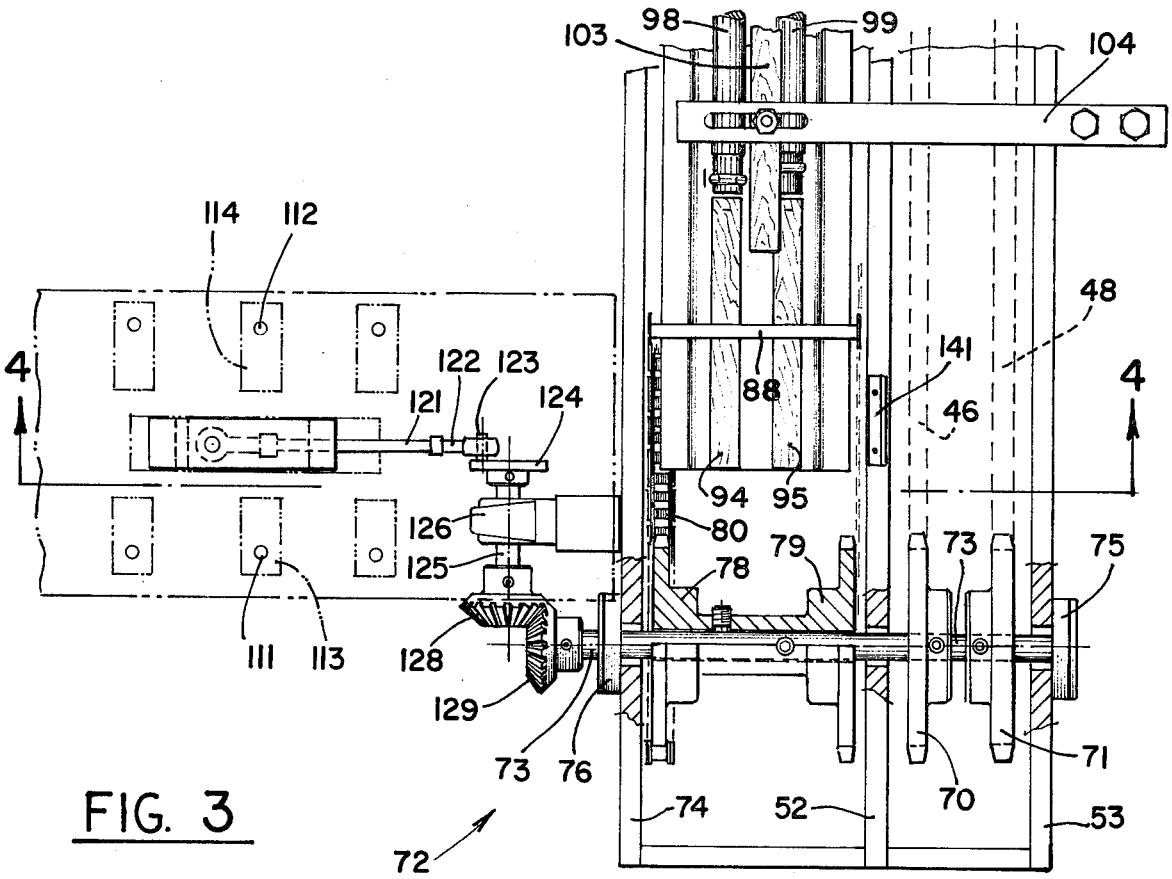
FIG. 3 is a top plan view of a suitable mechanism for feeding cards from a supply onto a conveyor for movement through the apparatus.
Figure 4:
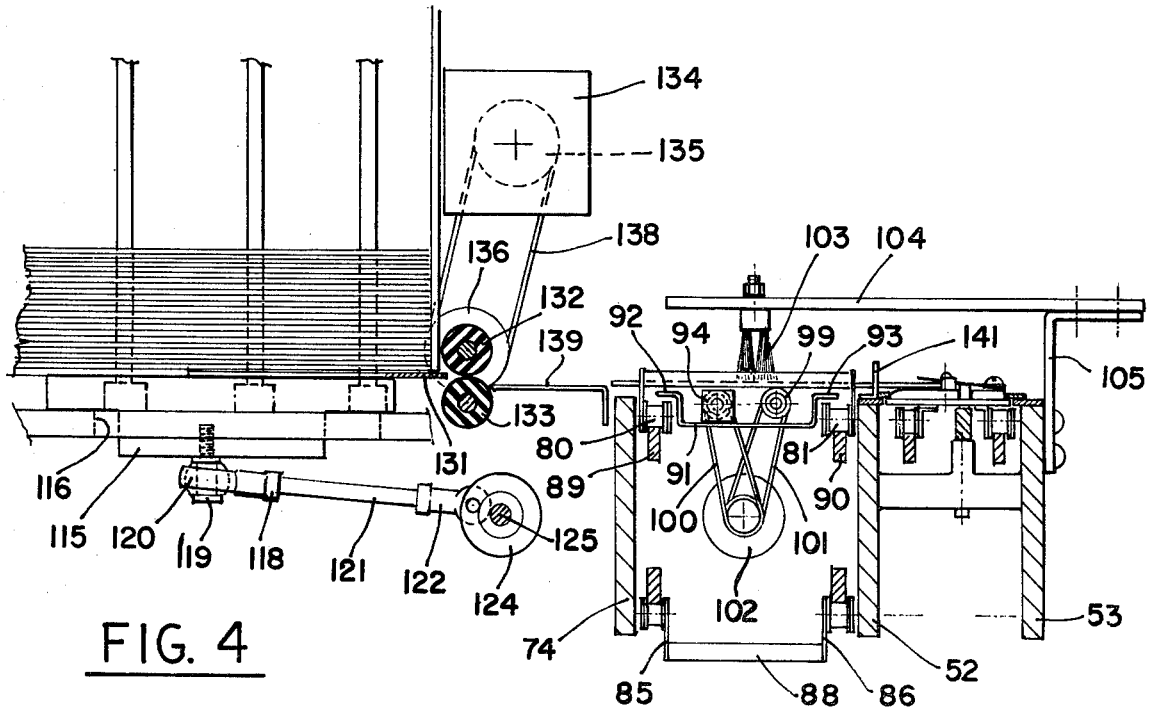
FIG. 4 is a cross-sectional sectional of a portion of the card feeding mechanism, taken substantially along line 4—4 of FIG. 3.

With specific reference to FIGS. 1, 3 and 4, operation of the card feeding assembly 38 shall next be explained. The assembly 38 includes a cardholder, generally 109, having a bedplate 110 supported by a frame (not shown) and suitably attached to the frame 36 of apparatus 35. A supply of display cards 22 is positioned within lateral guide rods 111 and 112 which extend upwardly from bars 113 and 114, respectively, which are movable along bedplate 110 in order to accommodate cards of varying dimensions. Feed of the cards from the stack is accomplished from the bottom of the pile by means of a reciprocating pusher plate 115 movable within a slot 116 in bedplate 110.

To drive pusher plate 115 a three-piece rod end 118 is employed having a stud 119, in a bearing 120, threadably engaging the plate 115. A tie rod 121 extends to a second rod end 122 which grips an arm 123 eccentrically mounted on a disc 124. Disc 124 is nonrotatably affixed to a shaft 125 journaled in a bearing assembly 126 suitably mounted to rear sideplate 74. A bevel gear 128 affixed to shaft 125 engages a gear 129 affixed to chain driven shaft 73.

Rotation of the disc 124, 180°, causes the pusher plate 115 to move the stack of cards 22 toward the trough 91. The cardholder 109 also includes a vertically adjustable frontal plate 130 and movable guide rods at the rear of the card stack, similar to the guide rods 111 and 112, but not shown. Adjustment of the frontal plate 130 from bars 113 and 114 to provide a narrow slot 131 permits only one display card 22 to extend therethrough upon forward thrust of the pusher plate 115. As the disc 124 rotates through the remaining 180°, the pusher plate 115 is driven rearwardly in bedplate slot 116. Movement of the card stack rearwardly is, however, prohibited by the rear guide rods.

While movement of the pusher plate 115 is sufficient to withdraw a single card 22 from the holder 109, in order to complete feeding onto the trough 91 and into the main body of the apparatus 35, a pair of rollers 132 and 133 are provided between the cardholder 109 and rear sideplate 74. The rollers 132, 133 are driven by a small motor 134 via pulleys 135 and 136 and belt 138. Mounting of the motor and rollers is in the general area depicted in FIG. 1, however, in order to aid clarity, a specific means has not been drawn.

The rollers 132 and 133 are spaced sufficiently to grip firmly a display card 22 thrust therebetween by pusher plate 115. Rotation thereof is relatively fast so that the card 22 is quickly expelled from the cardholder 109 and onto the blocks 94 and 95. In order to insure proper feeding of the card 22 over the sidewall 74 of the apparatus, a flange 139 is provided. An axially extending leg 140 from flange 139 is provided over sidewall 74 and is bent so as to urge the expelled card 22 toward a cardgripper 96. A second flange 141 (FIGS. 3 and 4) is provided, affixed to sidewall 52, in order to prohibit movement of a card 22 over a cardgripper 96 at the instant it is emitted from the cardholder 109.

Figure 5:
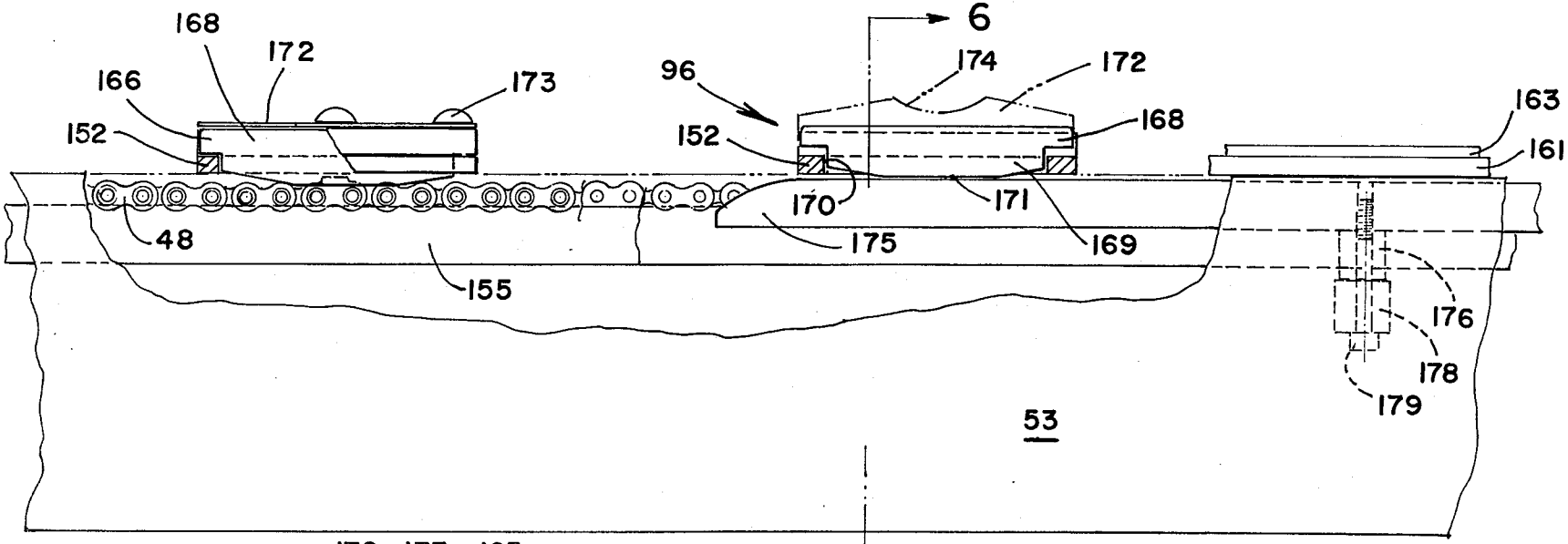
FIG. 5 is a side elevation depicting several of the cardgrippers of the apparatus.
Figure 7:
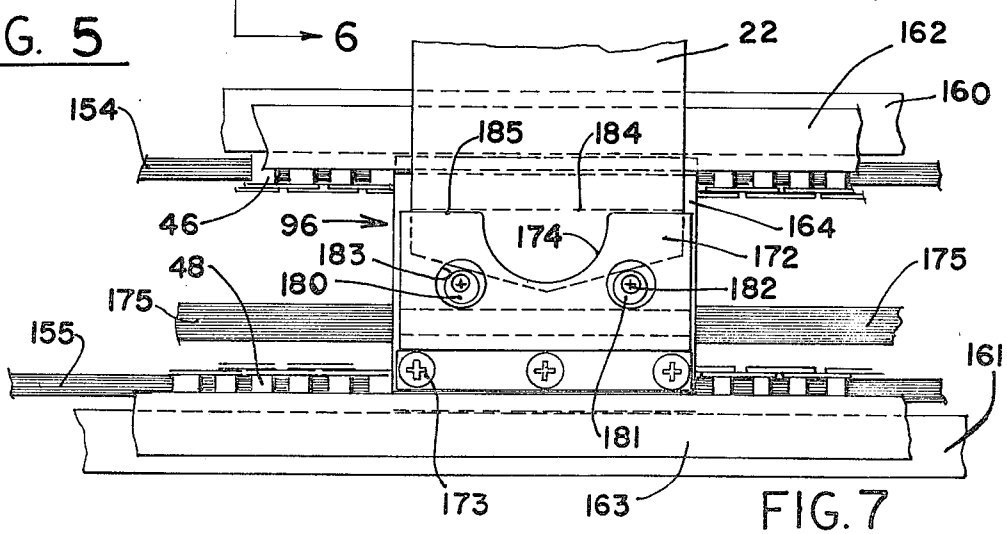
FIG. 7 is a top plan of a cardgripper with a card in position for movement through the apparatus.
Figure 6:
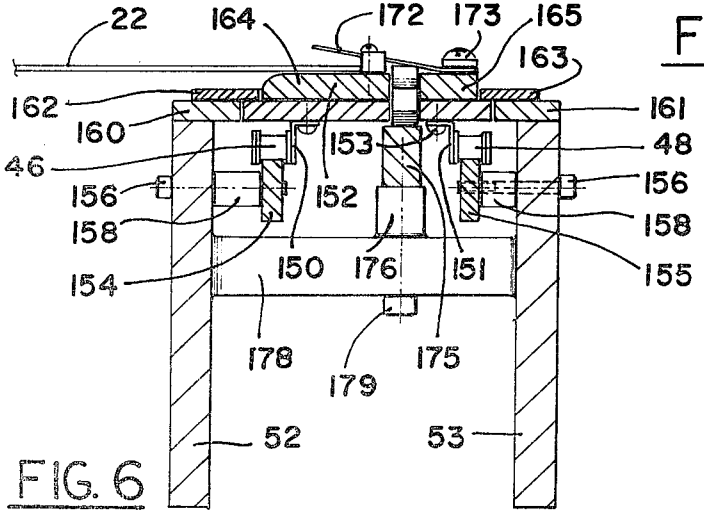
FIG. 6 is a cross-sectional view of a portion of the apparatus and a cardgripper taken substantially along the line 6—6 of FIG. 5.

With reference now to FIGS. 5–7, the remainder of the conveyor assembly 39 shall be explained. The chains 46 and 48 are employed to move the cards 22 through the apparatus. A plurality of cardgrippers 96 are affixed to the chains 46 and 48 via chain accessory links 150 and 151, respectively, which are connected to the base plate 152 of a cardgripper via screws 153. Chain slide rails 154 and 155 are again employed to support the chains 46 and 48 and are affixed to sideplates 52 and 53, respectively, via screws 156 and spacers 158. To maintain cardgripper base plate 152 in proper vertical position between the sideplates 52 and 53, inwardly directed rails 160 and 161 are provided. Cap rails 162 and 163 are affixed over rails 160 and 161 and the base plate 152 for proper horizontal alignment of the cardgripper 96.

Affixed to the top of the base plate 152 are guide plates 164 and 165 which permit vertical movement of a cam follower 166 therebetween. Cam follower 166 has an elongated upper half 168, which extends the length of base plate 152, and a shorter lower half 169, which passes through a slot 170 in base plate 152 terminating in a bottom edge 171 which normally lies below base plate 152. A flat spring steel finger 172 is affixed to the guide plate 165 via screws 173. The finger 172 passes over the cam follower and rests upon guide plate 164. A cutout portion 174 is provided for inspection of the placement of the display card 22 in the cardgripper 96.

Beneath the cam follower 166 is a cam rail 175 which is carried on a spacer 176 by a cross member 178 affixed between sideplates 52 and 53. Screws 179 are provided at suitable intervals to hold the cam rail 175 in position. With reference to FIG. 1, the cam rail 175 begins to lift the follower 166 and in turn the finger 172 a short distance after the display card 22 has been positioned on the blocks 94 and 95. Movement of the cardgripper 96 continues with the uplifted follower 166 and finger 172 while the card 22 is transported by the transverse positioning bar 88 over the rollers 98 and 99. As soon as the card 22 is fed by the rollers 98 and 99 onto the guide plate 164, the cam rail 175 allows the follower 166 and finger 172 to descend and the card is now firmly gripped between the guide plate 164 and spring finger 172 for subsequent operations through the apparatus 35.

Depth of receipt of the card 22 by the cardgripper 96 is readily provided for by eccentrics 180 and 181 fastened by screws 182 to guide plate 164. With reference to FIG. 7, it is readily seen that a fine degree of positioning may be obtained by loosening screws 182 and rotating the eccentrics 180 and 181. The finger 172 is cut out at 183 to clear both eccentrics so that while the finger is uplifted, the card 22 is fed directly against eccentrics 180 and 181 where it is held until the finger descends. Positioning of the card 22 within the cardgripper 96 is desirably adjusted so that a prescored fold line 184 is aligned with the leading edge 185 of the finger 172.

With reference again to FIG. 1, it is seen that advance of the card 22 and cardgripper 96 through the apparatus 35 next proceeds with a folding of the card from horizontally disposed to vertically. Inasmuch as a portion of the card remains held in the cardgripper 96, the card becomes folded at the line 184 forming the foot 26 and base 28 (FIG. 12) which provides support for the article to be packaged as well as allows the package 20 to be free-standing.

In order to accomplish the folding step, forming ramps 186 and 188 are employed providing a first incline (ramp 186) affixed to the rail 160 and a second, steeper incline (ramp 188) which completes the folding to essentially 90°. The ramps 186 and 188 are formed from small diameter round metal stock and are affixed at their upper ends to a bracket 189 extending from the rail 160. Beyond the folding area, the apparatus includes two parallel L-shaped guide rails 190 and 191 which maintain the upright disposition of the display card 22 for subsequent operations. Guide rails 190 and 191 are suspended above sideplates 52 and 53 by upright hangers such as 192 (FIG. 8A).

With reference now to FIGS. 1 and 8A, the article feeding means 40 shall be described. In order to provide a steady supply of the articles 21, i.e., bottles as depicted in the drawings, to the apparatus 35, a conventional accumulator/feed turntable may be utilized. Such equipment is commercially available and known to those in the packaging industry and therefore shall not be described herein. An accumulator of the type compatible with the apparatus 35 has its own power supply which drives a slowly rotating turntable 200 upon which an operator places the articles to be packaged.

In order to divert a continuous stream of the bottles from the turntable, the apparatus 35 includes a feed hopper 201 supported by a frame 202 connected to sideplate 52. The outer wall 203 of the hopper 201 is generally concentric with the circumferential edge 204 of the turntable, while the inner wall 205 of the hopper gradually turns toward the center of the turntable. As the turntable rotates, enough of the bottles are diverted into the feed hopper 201 by the inner wall 205, or the operator, to form a single row of articles advancing in the direction of the arrow A.

A feedwheel indicated by the numeral 206, rotating in the direction of the arrow B, has identical upper and lower discs, 208 and 209, respectively, each with four radially inwardly directed ramps 210–213, each terminating in a respective recess or pocket 214–217, to move one article. Each ramp and recess, e.g., 210 and 214, serves to remove one bottle from the feed hopper 201 and progress it toward a display card 22. The upper and lower discs 208 and 209 are spaced apart by a middle disc 218, the radius of which is slightly less than the smallest radius of any of the ramps 210–213. A floor plate 219 provides bottom support for the bottles, while adjustable outer sidewalls 220 and 221 serve to enclose a passageway for movement thereof as they are advanced toward a display card 22. A movable sidewall or gate 222 is operable to allow passage of a bottle to a display card when in open position (FIG. 8A) or to allow return of a bottle to the turntable 200 when in closed position (depicted in FIG. 11 and in phantom in FIG. 8A).

Deposit of a bottle 21 from the recess 216 of the feedwheel is synchronized so as to be received by the opening 23 in card 22. Removal of the bottle from the feedwheel 206 is insured by a guide ramp 223 which may be affixed to card guide rail 191 and extends above upper disc 208 as does a portion of the bottle 21.

In the event no display card is present in an advancing cardgripper 96, the gate 222 remains closed (FIG. 11), the tip 224 of gate 222 pivoting into engagement with the circumferential edge of the middle disc 218 of feedwheel 206, thereby diverting the bottle 21 along an exit ramp 225 and floor plate 202 back onto the turntable 200. The gate 222, pivotally mounted to the sidewall 221, is normally closed by the action of a spring biased piston 226 of a hydraulic actuating cylinder 228 secured to an arm 229. Actuation of the cylinder 228 retracts the piston 226 pivoting the gate 222 open so that a bottle 21, in pocket 215 of FIG. 8A, will be fed along the floor plate 219 to an arriving display card 22.

Figure 11:
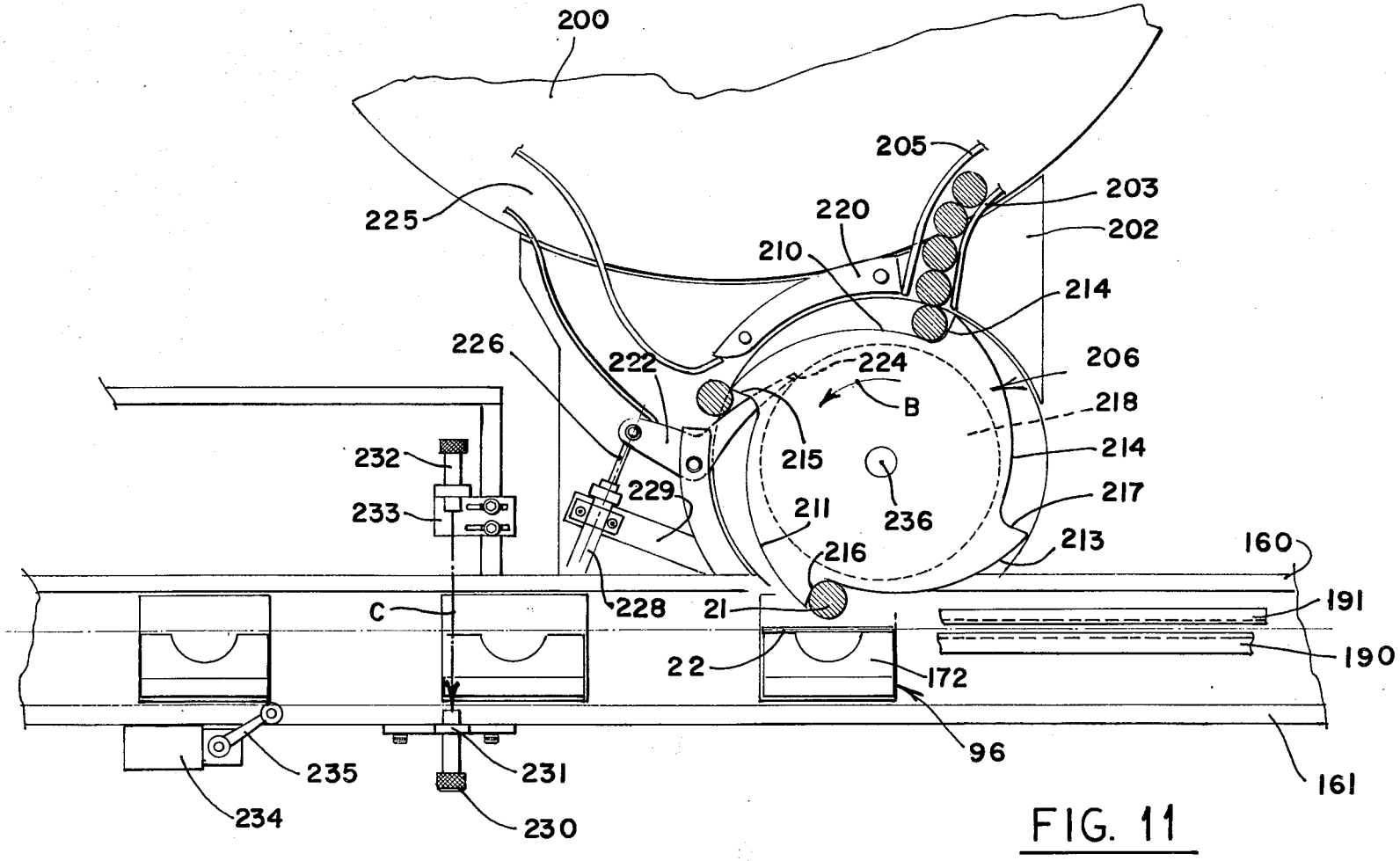
FIG. 11 is a top plan view of the article feeding mechanism first depicted in FIG. 8A and depicting operation of a gate refusing entry of the article into the conveyor system of the apparatus.

Actuation of the cylinder 222 is controlled by an electric eye 230 carried by a bracket 231 affixed to sideplate 53. Focused directly across from the eye 230 is a light beam source 232 affixed to a suitable bracket 233. Both the light source 232 and eye 230 are adjusted so that the upper portion of a display card 22 will break the beam of light as it passes therethrough. When the beam is thus broken, as depicted by the arrow C in FIG. 8A, a microswitch is thrown to actuate the cylinder 228 permitting the bottle in recess 215 to remain in the feedwheel 206 for receipt by that particular display card. If, however, no card has been received by a cardgripper 96, the light beam C strikes the eye 230, as depicted in FIG. 11, the cylinder 228 is not activated, and the gate 222 remains closed. In this situation, the bottle 21 from feedwheel recess 215 is diverted to the exit ramp 225.

A microswitch 234 is also provided having an arm 235 which is engageable with the guide plate 165 of a cardgripper 96. The switch 234 is preferably mounted to the frame above the cardgrippers 96, or it may be affixed to sideplate 53 as depicted in the drawings. When the arm 235 is unthrown (FIG. 8A), the gate 222 remains closed unless the light beam C is interrupted by a display card 22 as has been explained. However, when the arm 235 is tripped (FIG. 11), the cylinder 228 is actuated, opening the gate 222 for passage of the next bottle 21, overriding the light beam C and eye 230. Of course, at this time the bottle 21, which would have been delivered to the empty cardgripper 96 has been deflected to the turntable 200 and another bottle in recess 214 has started to move. While the gate 222 remains open until the cardgripper 96 clears the microswitch 234, it closes momentarily, to deflect the incoming bottle unless the light beam is again deflected by a display card 22.

With brief reference to FIG. 2, it is seen that the feedwheel 206 is driven by a shaft 236 carrying a sprocket 238 driven by another sprocket 239 via chain 240. The sprocket 239 is carried at the end of another shaft 241 having a bevel gear 242 engageable with a bevel gear 243 from a right angle drive unit 244. Drive unit 244 is in turn driven by a shaft 245 deriving its power from a second right angle drive unit 246. A shaft 248 having a sprocket 249 provides the input to angle drive unit 246 via chain 250, which is driven by sprocket 251 on drive shaft 59. Thus, through a series of gears, sprockets and chains, the feedwheel 206 is driven by the motor 66 and is synchronized so that four articles may be fed to form consecutive cardgrippers 96 for each revolution thereof.

After an article 21 and display card 22 have been united, they are carried by cardgripper 96 further along the apparatus to the first label applicating means 41 depicted schematically in FIG. 8B. As with the accumulator discussed hereinabove, commercially available labelling units may readily be employed with the apparatus 35 and therefore, the specific detailed construction and operation of this unit shall not be presented. The particular labelling unit utilized with the apparatus 35 is manufactured by Elconco Corporation of Minnetonka, Minnesota, and bears the name ACCRAPLY.

The unit is self-powered via an electric motor contained within a housing 260 that can be readily connected to the frame 36. The unit carries a supply reel 261 of pressure-sensitive adhesive backed labels 25 contained on a strip of treated paper 263, Kraft or the like, from which the labels can be peeled without loss of their adhesive. The supply reel 261 is rotatably mounted on a spindel 264 presented from an adjustable arm 265. A guide bar 266 and roller 268 is provided to direct the strip 263 to the apparatus 35. The strip 263 is directed around a peeler plate 269 presenting a sharp acute angle which breaks the edge of an adhesive backed label 25 therefrom.

Deposit of the label, which is explained next, takes place while the strip of treated paper is drawn between a drive roller 270 and pinch roller 271 onto a take-up reel 272, rotatably mounted on a spindle 273 presented from an adjustable arm 274. As is evident from FIG. 8B, the label 25, peeled from the paper 263, will be contacted by the article 21, withdrawn from the paper 263 and taken away with the article by the cardgripper 96. Equally evident is that a label 25 is preferably not released from the paper 263 when an empty cardgripper 96 passes. Because the label is freely peeled from the paper by the peeler plate 269, it is imperative that the paper not advance through the label machine when an empty cardgripper 96 is presented.

In order to signal advance of the paper 263, a switch 275 is provided having an arm 276 engageable with a display card 22. When the arm 276 is thus tripped, as is about to happen in FIG. 8B, the motor of the label applicating assembly 41 is activated and the label is peeled free by passing around the peeler plate 269 and contacting the article 21. In order to turn the motor off while the next cardgripper 96 is advanced to receive a label, a deactivator 278 is employed. The deactivator 278, which is mounted on the frame 36, has a sensor 279 capable of detecting the space between labels. When such a space is detected, the paper 263 ceases to move and remains stationary until the arm 276 is again tripped by a subsequent display card 22.

With reference now to FIGS. 8B and 8C, the operation of the first label affixing assembly 41 shall be described. The assembly 41 comprises first and second counterrotating label affixing elements 285 and 286, respectively. The first element 285 is secured to the shaft 241 (FIG. 2) and rotates at one-half of the speed of the feedwheel 206 due to the relative sizes of the respective drive sprockets 239 and 238. The shaft 241 is journaled in suitable bearing supports (not shown) along the sideplate 52 so as to be rotatable into the path of the advancing cardgrippers 96.

The element 285 is provided with identical recesses 288 which closely conform to one-half the profile of the body of the article 21. The recess 288 is dimensioned so as to apply even pressure upon the label 25 and against the article 21. Excess label material, ends 29 and 30, extend beyond the article body and adhere to the display card 22 thereby affixing the article to the card as described in conjunction with FIGS. 12 and 13.

The second element 286 is provided with four support blocks 289 each having a recess 290 for mating engagement with the profile of the article 21. A taper lock bearing 291, adjustably affixes the element 286 on a drive shaft 292 journaled in suitable bearings (not shown) from the frame 36.

The purpose of the second rotating element 286 is to provide support for the article and display card as the label 25 is forced against the pair from the opposite side by the first element 285. Obviously, the two recesses 288 and 290 must be completely aligned for proper passage of an article 21 therebetween and their timing is therefore controlled by adjustment of the drive system for the two elements 285 and 286 and the fine adjustment provided by taper lock bearing 291.

As clearly depicted in the drawings, the radius from the shaft 292 to the recess 390 of the element 286 is greater than that between the shaft 241 and recess 288 of the first element 285 because the article and display card do not pass equidistant between the two shafts. In order to provide proper synchronization between the first and second elements, so that each consecutive respective pair of recesses 288 and 290 can meet to enclose one bottle 21, the shaft 292 is driven at substantially one half the speed of shaft 241 by a larger gear 293 which meshes with a gear 294 from right angle drive unit 244.

Once the first label 25 has been affixed to the article and display card at assembly 41, the cardgripper 96 is advanced to the second label applicating means 43. Structure and operation of the means 43 is substantially identical to that described hereinabove for the first labelling means 41 and therefore identical primed numbers are utilized for this description. With reference to FIG. 8C, the labelling unit is self-powered via an electric motor contained within a housing 260' that can be readily connected to the frame 36. The unit carries a supply reel 261' of pressure-sensitive adhesive backed labels 24 contained on a strip of treated paper 263'. The supply reel 261' is rotatably mounted on a spindel 264' presented from an adjustable arm 265'. A roller 268' is provided to direct the strip 263' to the apparatus 35. The strip 263' is directed around a peeler plate 269' presenting a sharp acute angle which breaks the edge of an adhesive backed label 24 therefrom.

Deposit of the label takes place while the strip of treated paper is drawn between a drive roller 270' and pinch roller 271' onto a take-up reel 272', rotatably mounted on a spindle 273' presented from an adjustable arm 274'. The label 24, peeled from the paper 263', will be contacted by the article 21, withdrawn from the paper 263' and taken away with the article by the cardgripper 96.

To advance the paper 263', a switch 275' is provided having an arm 276' engageable with a display card 22. When the arm 276' is thus tripped, the motor of the label applicating assembly 43 is activated and the label is peeled free by passing around the peeler plate 269' and contacting the article 21. In order to turn the motor off while the next cardgripper 96 is advanced to receive a label, deactivator 278' is employed. The deactivator 278' has a sensor 279' capable of detecting the space between labels. When such a space is detected, the paper 263' ceases to move and remains stationary until the arm 276' is again tripped by a subsequent display card 22.

Once the second label 24 has been applied to the article and display card by the labelling means 43, the card-gripper 96 is advanced to the second label affixing assembly 44. Structure and operation of the affixing assembly 44 is similar to that described hereinabove for the first assembly 44 and therefore identical primed numbers are utilized for similar elements in this description.

The assembly 44 comprises first and second counterrotating label affixing elements 285' and 286', respectively. The first element 285' is secured to a shaft 300 (FIG. 2) which rotates at the same speed as the label affixing element 285. The shaft 300 is journaled in suitable bearing supports (not shown) along the sideplate 52 so as to be rotatable into the path of the advancing cardgrippers 96. The shaft 300 is provided with a gear 301 which in turn is driven by an output gear 302 from the right angle drive unit 246. A second output gear 303, from unit 246, drives a gear 304 and shaft 305 to which the second label affixing element 286' is secured. The element 285' is provided with identical recesses 288' which closely conform to one-half the profile of the body of the article 21.

The second element 286' is provided with four support blocks 289' each having a recess 290' for mating engagement with the profile of the article 21. A taper lock bearing 291', adjustably affixes the element 286' on the drive shaft 305 journaled in suitable bearings (not shown) from the frame 36.

The purpose of the second rotating element 286' of label affixing assembly 44 is to apply pressure upon the label 24 and against the article 21 as the article is held within the recess 288' of the first element 285'. Obviously, the two recesses 288' and 290' must be completely aligned for proper passage of an article 21 therebetween and their timing is therefore controlled by adjustment of the drive system for the two elements 285' and 286' and the fine adjustment provided by taper lock bearing 291'.

To facilitate removal of the article 21 from the card 22 by the consumer, the first applied label 25 is perforated at the juncture lines between article and card by perforating knives 306 having a plurality of sharp teeth 308 (FIG. 10). The knives 306 are adjustably maintained within parallel vertical slots 309 of the first element 285' by an adjustment screw 310 and a locking screw 311 (FIG. 9). Thus, while the article and bottle are being supported by the element 285' for affixation of the label 24 via element 286', the knives 306 are simultaneously perforating the label 25.

The package 20 has now been completely assembled. In order to remove it from the cardgripper 96 a second cam rail 312 is provided which is mounted between sideplates 52 and 53 similarly to the cam rail 175 described in conjunction with FIG. 6. Upon contacting the cam rail 312, the cam follower 166 of cardgripper 96 is lifted carrying with it the spring finger 172 thereby momentarily releasing the base 28 of the display card 22.

A short burst of air is ejected from a bar 313 directly against the display card 22 as the cardgripper 96 passes over cam rail 312. The air blows the finished package 20 from the apparatus 35 to an awaiting collector such as a conveyor belt or container or the like, not shown. As the cardgripper passes beyond the cam rail 312 it rounds the sprockets 49 and 50 and travels back to the card feeding assembly 38 to repeat the packaging cycle.

The air bar 313 is supported by a bracket 314 (FIG. 2) affixed to sideplate 53 and is supplied via a suitable air line 315 from a source, not shown. The flow of air is intermittently provided by a regulator 316 controlled by microswitch 318. An arm 319 from the microswitch is engaged by an adjustable cam lever 320 affixed to drive shaft 245. The cam lever is dual-activating so that each revolution of shaft 245 triggers an air blast for the removal of two packages from the apparatus 20.

In the event any of the foregoing operations are conducted improperly, it is likely that the apparatus 35 could jam possibly injuring an operator or damaging one or more of the assemblies. In the event of jamming, an overload on the motor 66 will occur. As a safety device, a clutching mechanism 321 is provided in the drive train 45. At the first detection of increased force to run the apparatus 35, a pin 322 is urged radially outwardly from the clutch 321. Upon one revolution thereof, the pin 322 will throw a lever arm 323 from a microswitch 324 which immediately shuts the power to the motor 66 stopping the apparatus 35.

Thus, it should be evident that the disclosed device carries out the objects of the invention set forth above. As apparent to those skilled in the art, modifications can be made without departing from the spirit of the invention herein disclosed and described, the scope of the invention being limited solely by the scope of the attached claims.

I claim:

1. Apparatus for the preparation of display packages, having an article supported by a display card and at least one label, comprising:

a conveyor assembly for moving horizontal display cards through said apparatus whereby operations for forming the display package can be performed said conveyor assembly includes a plurality of card grippers for holding a portion of a display card;

a card feeding assembly for supplying single cards to said conveyor assembly;

means for folding a display card to present a vertically disposed portion for receipt of the article;

article feeding means for supplying the article to be packaged to said conveyor assembly and in juxtaposition with said vertical portion of the card;

labelling means; and, affixing means for securing said label directly to the article and the display card to thereby secure the article to the card.

2. Apparatus for the preparation of display packages, as set forth in claim 1, wherein said card feeding assembly includes;

a cardholder for storing a plurality of display cards;

a pusher plate communicating with said cardholder and a display card;

means for reciprocating said pusher plate whereby a single display card is emitted from the supply;

a table for receipt of the display card from said cardholder; and, means for directing the display card from said table to said cardgripper.

3. Apparatus for the preparation of display packages, as set forth in claim 1, wherein said article feeding means includes:

a rotating table for receipt of a supply of the articles;

a feedwheel having at least one recess for removal of an article from said turntable and transfer to said card-gripper and folded display card;

means for guiding and articles from said turntable to said feedwheel and with said feedwheel to said cardgripper; and, means for the selective passage of an article away from or back to said turntable.

4. Apparatus for the preparation of display packages, as set forth in claim 3, wherein said labelling means includes:

a rotatably mounted supply reel of pressure sensitive labels carried on a strip of release paper;

a take-up reel for the release paper;

a peeler plate, around which the release paper is drawn, to break the edge of the label therefrom and present it into the path of an advancing cardgripper for contact with an article carried thereby; and, 5. Apparatus for the preparation of display packages, as set forth in claim 4, wherein said affixing means includes:

first and second counterrotating elements;

at least one recess in said first element which forces the label from said labelling means against the article and a portion of said folded display card; and, at least one recess in said second element which supports the article for application of the label by said recess in said first element.

6. Apparatus for the preparation of display packages, as set forth in claim 5, further comprising:

a second labelling means; and, a second affixing means for securing said label to the article.

7. Apparatus for the preparation of display packages, as set forth in claim 6, wherein said second labelling means includes:

a rotatably mounted supply reel of pressure sensitive labels carried on a strip of release paper:

a take-up reel for the release paper;

a peeler plate, around which the release paper is drawn, to break the edge of the label therefrom and present it into the path of an advancing cardgripper for contact with an article carried thereby; and, wherein said second affixing means includes:

first and second counterrotating elements;

at least one recess in said first element which supports the article for application of the label; and, at least one recess in said second element which forces the label from said second labelling means against the article.

8. Apparatus for the preparation of display packages, as set forth in claim 7, wherein said second affixing means further includes:

at least one knife carried by said first element of said second affixing means whereby the label applied from said first labelling means is perforated as the label from said second labelling means is affixed to the article.

9. Apparatus for the preparation of display packages, having an article supported by a display card and at least one label, comprising:

a conveyor assembly for moving horizontal display cards through said apparatus whereby operations for forming the display package can be performed said conveyor assembly includes a plurality of card grippers for holding a portion of a display card;

a card feeding assembly for supplying single cards to said conveyor assembly;

means for folding a display card to present a vertically disposed portion for receipt of the article;

article feeding means for supplying the article to be packaged to said conveyor assembly and in juxtaposition with said vertical portion of the card;

first and second labelling means for feeding first and second labels;

first affixing means for securing said first label directly to the article and the display card to thereby secure the article to the card;

second affixing means for securing said second label to the article.

10. Apparatus for the preparation of display packages, as set forth in claim 9, wherein said card feeding assembly includes:

a cardholder for storing a plurality of display cards;

a pusher plate communicating with said cardholder and a display card;

means for reciprocating said pusher plate whereby a single display card is emitted from the supply;

a table for receipt of the display card from said cardholder; and, means for directing the display card from said table to said cardgripper.

11. Apparatus for the preparation of display packages, as set forth in claim 10, wherein said means for directing includes:

a bar;

means for moving said bar over said table whereby a display card deposited thereon is moved with said bar;

a roller assembly mounted generally perpendicularly to and below said bar for receipt of a display card from said table; and, means for rotating said roller assembly whereby a card deposited thereon is urged into engagement with said cardgripper.

12. Apparatus for the preparation of display packages, as set forth in claim 11, wherein said cardgripper comprises:

a base plate, having an elongated slot passing therethrough, and secured to said means for moving said cardgrippers;

first and second guide plates affixed to said base plate;

a cam follower having an upper half vertically movable between said first and second guide plates and a lower half extending through said slot;

a spring plate affixed to said guide plate and movable away from said second guide plate with said cam follower.

13. Apparatus for the preparation of display packages, as set forth in claim 12, further including:

a cam rail mounted beneath said cardgripper for elevation of said cam follower and spring plate for receipt of a display card by said cardgripper from said roller assembly.

14. Apparatus for the preparation of display packages, as set forth in claim 9, wherein said article feeding means includes: a rotating table for receipt of a supply of the articles;

a feedwheel having at least one recess for removal of an article from said turntable and transfer to said cardgripper and folded display card;

means for guiding the articles from said turntable to said feedwheel and with said feedwheel to said cardgripper; and, means for the selective passage of an article away from or back to said turntable.

15. Apparatus for the preparation of display packages, as set forth in claim 14, wherein said means for guiding the articles includes:

a hopper for directing the articles from said turntable to said feedwheel;

a guide ramp directing the articles from said feedwheel to said turntable; and, wherein said means for selective passage includes:

a movable gate engageable with a portion of said feedwheel;

means for moving said gate toward said feedwheel, whereby an article is returned to said turntable, and away from said feedwheel, whereby an article is advanced to said card-gripper and folded card; and, sensing means to detect the presence of an advancing display card with a cardgripper for receipt of an article.

* * * * *